US009532613B2

(12) United States Patent
Foley et al.

(10) Patent No.: US 9,532,613 B2
(45) Date of Patent: Jan. 3, 2017

(54) GARMENT WITH INTEGRATED PROTECTIVE PADDING

(71) Applicants: Andrew Foley, Watertown, SD (US); Vincent Foley, Watertown, SD (US)

(72) Inventors: Andrew Foley, Watertown, SD (US); Vincent Foley, Watertown, SD (US)

( * ) Notice: Subject to any disclaimer, the term of this patent is extended or adjusted under 35 U.S.C. 154(b) by 0 days.

(21) Appl. No.: 14/164,415

(22) Filed: Jan. 27, 2014

(65) Prior Publication Data

US 2014/0208492 A1 Jul. 31, 2014

Related U.S. Application Data

(60) Provisional application No. 61/756,495, filed on Jan. 25, 2013, provisional application No. 61/757,521, filed on Jan. 28, 2013.

(51) Int. Cl.
*A41D 13/05* (2006.01)
*A41D 13/015* (2006.01)

(52) U.S. Cl.
CPC ..... *A41D 13/015* (2013.01); *A41D 13/05* (2013.01)

(58) Field of Classification Search
CPC .. A41D 13/015; A41D 13/0156; A41D 13/05; A41D 1/02; A41D 1/04; A41D 1/08; A41D 1/082; A41D 1/084; A41D 13/0015; A41D 13/0153; A41D 2600/10
USPC ..... 2/467, 459, 456, 465, 69, 79, 23, 267
See application file for complete search history.

(56) References Cited

U.S. PATENT DOCUMENTS 1,777,878 A * 10/1930 Evans ..... A41D 13/0518 2/465
1,841,193 A * 1/1932 Lidston ..... A63B 71/143 2/16
3,285,768 A * 11/1966 Habib ..... B26D 3/006 428/160

(Continued)

FOREIGN PATENT DOCUMENTS

EP 1523898 A1 4/2005
EP 2 283 738 A1 2/2011

(Continued)

OTHER PUBLICATIONS

Neo Prodigy Suit Technology, by Neo-Athletics, 3 pages, 2014. Printed Feb. 12, 2014 from http://neo-athletics.com/pages/suit-technology.

(Continued)

*Primary Examiner* — Amy Vanatta
(74) *Attorney, Agent, or Firm* — Patterson Thuente Pedersen, P.A.

(57) ABSTRACT

A garment having a piece of clothing with a plurality of pad segments located proximate a backside of a wearer's body, including at least one joint region, for protecting the wearer by dissipating energy resulting from a sudden impact. The pad segments arranged with respect to the interior radius of the joint region such that an interstitial space located between each adjacent pad segment becomes narrower moving a protruding portion of each adjacent pad segment closer together, and in some instances such that the adjacent protruding portions touch one another, when the joint region moves from an extended position to a flexed position. The garment with energy dissipating pad segments may be used alone or in conjunction with pads that shield energy.

18 Claims, 4 Drawing Sheets

(56) References Cited

U.S. PATENT DOCUMENTS 4,272,850 A * 6/1981 Rule ..... A41D 13/065 2/24
4,538,301 A * 9/1985 Sawatzki et al. ..... 2/467
4,688,269 A * 8/1987 Maeshima ..... 2/456
4,700,407 A * 10/1987 Mattila ..... A41D 13/015 2/16
5,035,009 A * 7/1991 Wingo, Jr. ..... A42B 3/121 2/414
5,052,053 A * 10/1991 Peart et al. ..... 2/2.16
5,337,418 A * 8/1994 Kato et al. ..... 2/456
5,551,082 A * 9/1996 Stewart et al. ..... 2/465
5,581,809 A * 12/1996 Mah ..... A41D 19/01523 2/161.1
6,289,524 B1 * 9/2001 Wright ..... A41D 13/015 2/455
6,301,722 B1 * 10/2001 Nickerson ..... A41D 13/015 2/22
6,432,513 B1 * 8/2002 Thomsen ..... A63B 71/1225 2/16
6,519,781 B1 * 2/2003 Berns ..... A41D 13/0153 2/267
6,743,325 B1 * 6/2004 Taylor ..... 156/265
6,874,168 B1 4/2005 Kuhuski
6,969,548 B1 * 11/2005 Goldfine ..... A41D 31/0061 206/523
7,523,508 B2 4/2009 Contant et al.
7,650,648 B2 * 1/2010 Roberts ..... 2/195.8
7,748,056 B2 7/2010 Mickle
D626,718 S 11/2010 Turner
D626,719 S 11/2010 Turner
7,891,026 B1 2/2011 Smith
8,484,766 B2 7/2013 Smith
2001/0023504 A1 * 9/2001 Yoon ..... 2/455
2005/0081277 A1 * 4/2005 Matechen et al. ..... 2/102
2006/0199456 A1 * 9/2006 Taylor ..... A41D 13/0156 442/224
2007/0199129 A1 8/2007 Davis
2008/0313793 A1 12/2008 Skottheim et al.
2009/0271916 A1 11/2009 Harris
2010/0115682 A1 * 5/2010 Lambertz ..... 2/16
2010/0293703 A1 11/2010 Tezartes-Strauss et al.
2011/0209264 A1 * 9/2011 Williams et al. ..... 2/69
2012/0240317 A1 * 9/2012 Diamond ..... A41D 13/0153 2/459
2013/0025035 A1 * 1/2013 Turner ..... A41D 13/0593 2/455
2013/0298317 A1 11/2013 Fonte et al.

FOREIGN PATENT DOCUMENTS

WO WO 0016652 A1 * 3/2000 ..... A41D 13/015
WO WO2013039945 A1 3/2013
WO WO2013154969 10/2013
WO WO2013181316 12/2013

OTHER PUBLICATIONS

Zoombang®, by ZB Products, Inc., Irwin, PA, 2 pages 2014. Printed Mar. 14, 2014 from http://zoombang.com.

* cited by examiner

GARMENT WITH INTEGRATED PROTECTIVE PADDING

PRIORITY CLAIM

This application claims priority from U.S. Provisional Patent Application No. 61/756,495, filed Jan. 25, 2013, and U.S. Provisional Patent Application No. 61/757,521, filed Jan. 28, 2013, the disclosures of which are hereby incorporated by reference herein in their entirety.

TECHNICAL FIELD OF THE INVENTION

The present invention relates generally to padded garments, and particularly garments integrated with strategically placed protective padding that allows the wearer to move with minimal restriction but also providing protection by dissipating energy resulting from a sudden impact at that location.

BACKGROUND OF THE INVENTION

Protective garments are well known to provide protection for a user in many different types of sports where sudden impact occurs as a result of activity or is a very real possibility, such as football, hockey, lacrosse, rugby, basketball, baseball and the like. Protective garments are worn to protect the user, such as athletes, from the energy force that results from sudden impact. Protective garments and equipment designed for use in contact sports typically rely on two modes of dissipating energy from impact forces, padding and shielding. Padding typically dissipates the energy force through elastic deformation of the padding material, while shielding deflects a portion of the energy force away from the body.

While there are numerous protective garments within the industry, one of the major problems in designing effective athletic gear is the need to balance protection with mobility. The proper balance can also be dependent upon the specific sport, such as to provide minimal restriction by the user for the types of movements that are utilized in that sport. For example, activities in football often result in sudden impact in the front and/or side portions of the body, such as the shoulders, head, hips, thighs and knee areas, whereas hockey and/or lacrosse also can receive sudden impact from a stick or the solid puck/ball in the front, side and/or backside portions of the body, including the elbows, triceps, forearm, lumbar area and/or buttocks. The proper balance can also be dependent upon the particular type of player in the respective sport, such as a quarterback compared to a defensive lineman in football or a goaltender compared to a center in hockey.

Some protective garments, such as shirts, shorts or pants, have used padding and/or segmented padding that is inserted into pockets or openings in the garment, which adds to the bulk of the garment and impedes mobility. Other protective garments have used segmented or articulated padding and/or shielding located on the exterior of the garment, which leaves interstices and/or joints between padding segments within which flexing and bending can take place. Placing the segmented or articulated padding and/or shielding on the outside of the garment, however, provides its own difficulties for padding located proximate the user's joint, such as the interstices in the segmented and/or articulated padding becoming bigger or wider when the proximate joint is flexed resulting in inadequate dissipation of energy force for protection.

Therefore, a need exists for garments with protective padding that provides a proper balance of protection and mobility to the user where sudden impact to the backside of the body is common while also providing adequate protection to joints throughout the entire range of motion.

SUMMARY OF THE INVENTION

In some embodiments, the present invention is directed at a garment having a piece of clothing with a plurality of pad segments located proximate a backside of a wearer's body for protecting the wearer by dissipating energy resulting from a sudden impact. In some aspects, the sudden impact can be the result of a fall backwards, a check into hockey boards or the goal, or a strike by a stick, ball or puck.

In some embodiments, the garment also has a plurality of pad segments located proximate at least one joint region. In certain aspects, the pad segments are arranged with respect to the interior radius of the joint region such that an interstitial space located between each adjacent pad segment becomes narrower moving a protruding portion of each adjacent pad segment closer together, and in some instances such that the adjacent protruding portions touch one another, when the joint region moves from an extended position to a flexed position.

In some embodiments, the garment with energy dissipating pad segments may be used alone or in conjunction with pads that shield energy.

In some embodiments, the present invention is directed to a protective garment having at least one piece of clothing, the clothing having a plurality of pad segments, each of the plurality of pad segments comprising a conformal, energy dissipating polymer composition surrounded by an encasement, each segment of the plurality of pad segments having a protruding portion separated from an adjacent protruding portion by an interstitial space. In some aspects, the plurality of pad segments are positioned at a location on a backside of the clothing proximate a buttocks region of the wearer to diminish the effect of a sudden impact on the wearer of the garment. In some other aspects, the plurality of pad segments are positioned at a location of the clothing proximate a joint region, wherein the plurality of pad segments located proximate the joint region are arranged such that the protruding portions of adjacent pad segments are capable of moving closer together when the joint region is in a flexed position than when the joint region is in an extended position.

In some embodiments, the present invention is directed to a protective garment conforming to a wearer's body contours, the garment comprising a plurality of pad segments comprising a conformal, energy dissipating polymer composition surrounded by an encasement connected directly to at least one piece of clothing, a first portion of the plurality of pad segments located proximate a joint region and a second portion of the plurality of pad segments located proximate a buttocks region, wherein the plurality of pad segments located proximate the joint region are arranged such an interstitial space located between each adjacent pad segment becomes narrower and a protruding portion of each pad segment are closer together when the joint region moves from an extended position to a flexed position. In some aspects, the joint region is an elbow region and/or a knee region.

In some embodiments, the plurality of pad segments are connected directly to the clothing.

In some embodiments, the encasement comprises polyurethane, urethane, PVC, nylon or neoprene. In some embodiments, the polymer composition comprises a visco-elastic, polymer material. In some embodiments, the polymer comprises polyborosiloxane. In some aspects, the clothing and the encasement are each made of nylon. In some other aspects, the clothing and the encasement are made of materials suitable to be welded to one another.

In some embodiments, the clothing comprises at least one material chosen from cotton, nylon, polyester, and elastane. In some aspects, the clothing conforms to the contour of the wearer's body. In some aspects, the clothing is compression clothing. In some aspects, the clothing is a unitard having sleeves, patent legs and/or an opening. In some other aspects, the clothing comprises a shirt having sleeves and either a pair of shorts or a pair of pants. In some embodiments, the clothing comprises sleeves having a thumb hole and a pair of pants with pant legs having stirrups.

In some embodiments, the plurality of pad segments are positioned not only on the backside of the garment proximate the buttocks regions, but also proximate at least one bodily region chosen from a tailbone, a forearm, an elbow, a knee, a shoulder, a hip, a thigh, a shin, and a lower back.

BRIEF DESCRIPTION OF THE DRAWINGS

The present invention may be more completely understood in consideration of the following detailed description of various embodiments of the invention in connection with the accompanying drawings, in which.

Figure 1B:
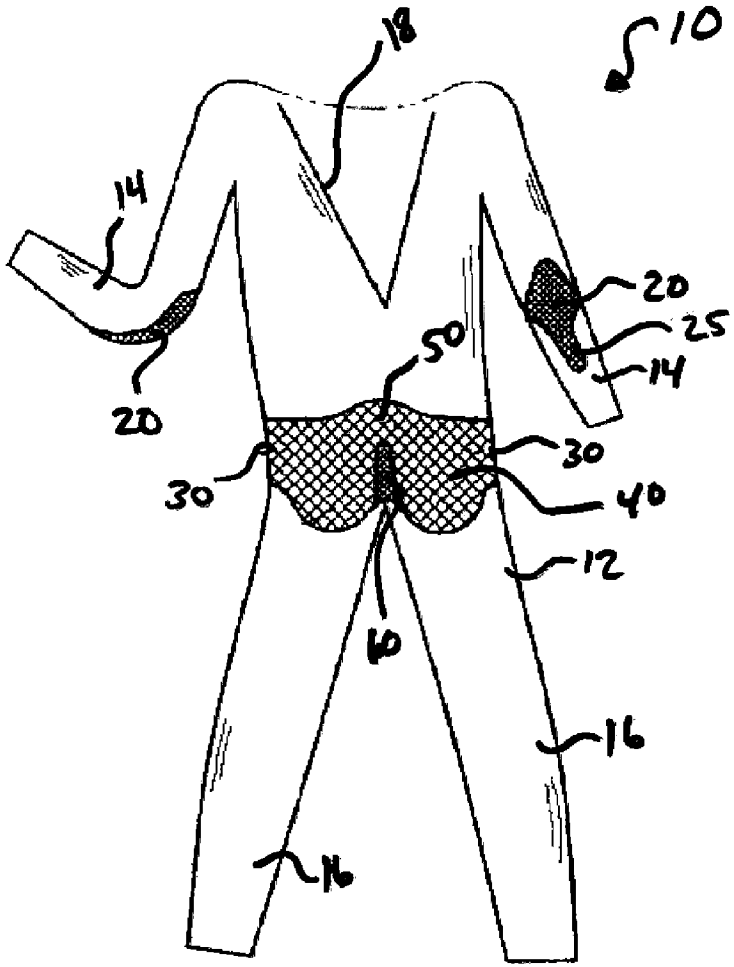
FIG. 1B is a backside perspective view of the garment in FIG. 1A having pad segments according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the present invention.

DETAILED DESCRIPTION OF THE DRAWINGS

The following detailed description should be read with reference to the drawings in which similar elements in different drawings are numbered the same. The drawings, which are not necessarily to scale, depict illustrative embodiments and are not intended to limit the scope of the invention.

Figure 1A:
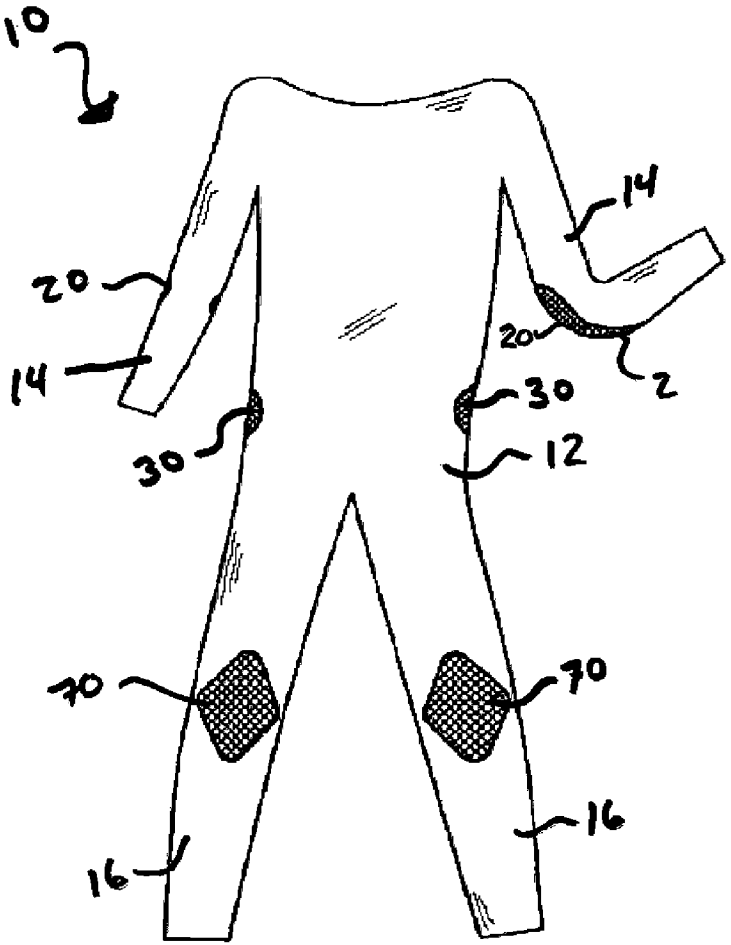
FIG. 1A is a frontside perspective view of a garment in the form of a unitard having pad segments according to an embodiment of the present invention.

Referring now to the figures, FIG. 1A illustrates a frontside perspective of garment 10 and FIG. 1B illustrates a backside perspective of garment 10, which comprises a piece of cloth 12 which, in this embodiment, is a unitard covering the wearer's entire torso region, the arm regions to the wrists, and the leg regions to the ankles. The cloth 12 may comprise a material to conform to the contours of the wearer's body, such as a compression material that custom fits the wearer such that the cloth 12 does not easily shift upon the body of the wearer. Instead, clothing 12 can have a fit that is tight enough such that the compression and/or elasticity of clothing 12 keeps attached padding in the proper location. While the garment 10 is illustrated with sleeves 14, the garment 10 may be sleeveless. Additionally, while the garment 10 is illustrated with full pant legs 16, the garment 10 may comprise shorts with the patent leg extending below the knee region or stopping above the knee region. In some aspects, cloth 12 of sleeves 14 can extend to the hand area to cover the wrist and/or palm, which can include a thumb hole. In some aspects, cloth 12 of pant legs 16 can extend to the foot area to cover the ankle and/or at least a portion of the foot, which can include a stirrup configuration to go around the bottom of the foot.

The garment 10 can have opening 18 on the backside proximate the neck region between the shoulder blades, which allows the wearer easy entry and exit from the garment 10. In some other embodiments, opening 18 may be located on the frontside proximate the neck and chest region. Opening 18 may be left open during normal use or closed with a zipper, tie strings, Velcro® type closure, button, snap, or other various other means to connect the two opposing separate pieces of material of clothing 12 on each side of opening 18. In some embodiments, the garment 10 may comprise a top shirt portion that is separate from a bottom portion at the waste area eliminating the need of opening 18, the bottom portion comprising full-length pants or shorts that extend anywhere between the shin and thigh regions.

The garment 10 can have at least one pad of conformal, energy dissipating media positioned at a location on the clothing 12 depending upon the activity to protect the wearer from the force of sudden impact that is typically associated with a particular activity. As shown in FIG. 1A, the pads may be located on the clothing 12 at the elbow region 20, forearm region 25, hip region 30, and/or knee region 70. As shown in the backside perspective view of garment 12 in FIG. 1B, the pads may also, or alternatively, be located on the clothing 12 at the elbow region 20, forearm region 25, hip region 30, buttocks region 40 (or just the gluteus maximus region), lumbar region 50, and/or tailbone region 60. In some aspects, the pads may be located in the wrist region and/or palm area.

Activities where balance is challenged and falls occur, such as hockey and lacrosse with backwards falls, can include padding located in the elbow region 20, forearm region 25, buttocks region 40 (or just the gluteus maximus region), lumbar region 50, and/or tailbone region 60 on the backside of the garment 10, such as shown in FIG. 1B.

Figure 2B:
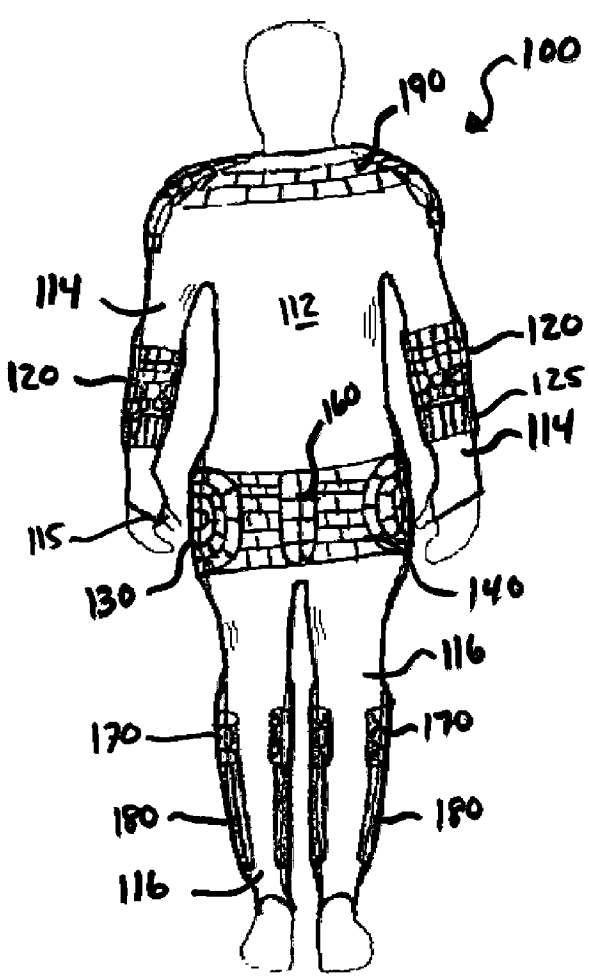
FIG. 2B is a backside perspective view of the garment in FIG. 2A having pad segments according to an embodiment of the present invention.
Figure 2A:
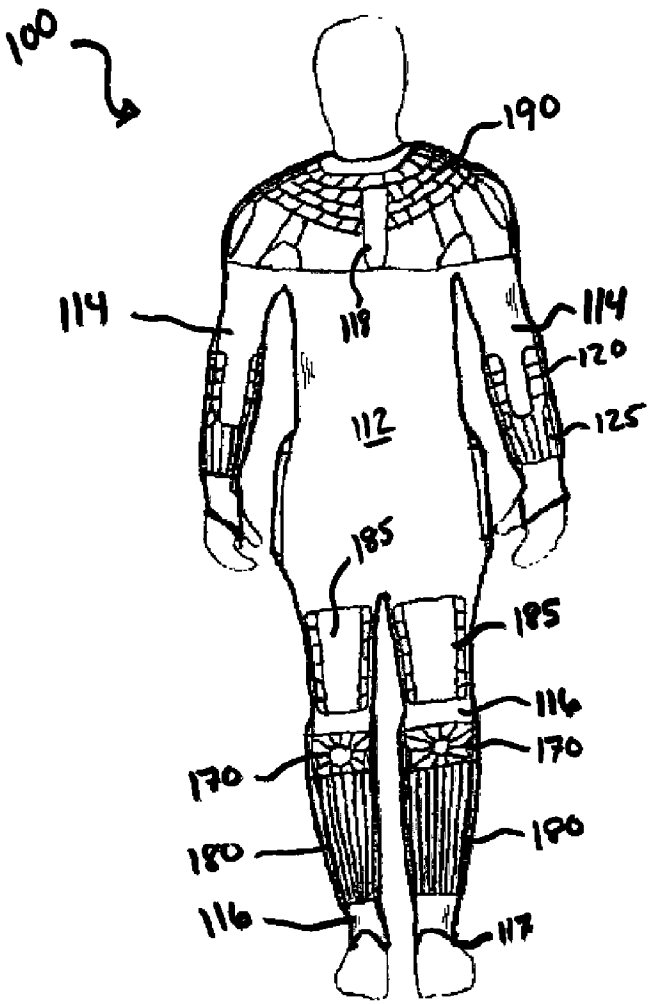
FIG. 2A is a frontside perspective view of a garment in the form of a unitard having pad segments according to an embodiment of the present invention.

Referring now to FIGS. 2A and 2B another garment embodiment is illustrated. FIG. 2A illustrates a frontside perspective of garment 100 and FIG. 2B illustrates a backside perspective of garment 100, which comprises at least one piece of cloth 112 which, in this embodiment, is a unitard covering the wearer's entire torso region, the arm regions to the wrists, and the leg regions to the ankles. Cloth 112 may comprise a compression material that custom fits the wearer such that cloth 112 does not easily shift upon the body of the wearer. Instead, clothing 112 can have a fit that is tight enough such that the compression and/or elasticity of clothing 112 keeps attached padding in the proper location. While the garment 100 is illustrated with sleeves 114, the garment 100 may be sleeveless. Additionally, while the garment 100 is illustrated with full pant legs 116, the garment 100 may comprise shorts with the patent leg extending below the knee region or stopping above the knee region. As shown in FIGS. 2A and 2B, sleeves 114 can extend to the hand area to cover the wrist and/or palm, which can include a thumb hole 115. Pant legs 116 can also, or alternatively, extend to the foot area to cover the ankle and/or at least a portion of the foot, which can include a stirrup 117 that goes under the bottom of the foot to keep the pant leg 116 in proper position.

The garment 100 can have opening 118 located on the frontside proximate the neck and chest region. In some other embodiments, opening 118 can be located on the backside proximate the neck region between the shoulder blades, which allows the wearer easy entry and exit from the garment 110. Opening 118 may be left open during normal use or closed with a zipper, tie strings, Velcro® type closure, button, snap, or other various other means to connect the two opposing separate pieces of material of clothing 112 on each side of opening 118. In some embodiments, the garment 100 may comprise a top shirt portion that is separate from a bottom portion at the waste area eliminating the need of opening 118, the bottom portion comprising full-length pants or shorts that extend anywhere between the shin and thigh regions.

The garment 100 can have at least one pad of conformal, energy dissipating media positioned at a strategic location on the clothing 112, corresponding to joints and/or muscles susceptible to repeated contact, depending upon the activity to protect the wearer from the force of sudden impact that is typically associated with the particular activity. As shown in FIG. 2A, the pads may be located on the clothing 112 at the elbow region 120, forearm region 125, hip region 130, knee region 170, shin region 180, thigh region 185, and/or shoulder region 190. As shown in the backside perspective view of garment 100 in FIG. 2B, the pads may also, or alternatively, be located on the clothing 112 at the elbow region 120, forearm region 125, hip region 130, buttocks region 140 (or just the gluteus maximus region), lumbar region 150, tailbone region 160, knee region 170, shin region 180, and/or shoulder region 190. In some aspects, the pads may be located in the wrist region and/or palm area. In some aspects, the pads surround the entirety of the respective region, such as the forearm region 125 shown in FIGS. 2A and 2B. In some aspects, the pads are only located on one side of the garment 100 with respect to the body region, while in some other aspects the pads are substantially located on one side but partially located on the other side of the garment, such as the elbow region 120, knee region 170, and/or shin region 180 as shown in FIGS. 2A and 2B, such that the respective padding covers the respective side of the body region.

In sports such as hockey and lacrosse where balance is challenged and falls occur during play, such as backwards falls, or sudden impact strikes to the backside of the player is commonplace, such as sticks, balls or pucks, checks into the boards or goal, garment 100 can include padding located in the elbow region 120, forearm region 125, buttocks region 140 (or just the gluteus maximus region), lumbar region 150, and/or tailbone region 160 on the backside of the garment 100, such as shown in FIG. 2B.

Cloth 112 with directly connected padding allows for the placement of all padding during the dressing step, allowing for the placement of padding for the appropriate high kinetic energy impact that can be expected in one simple step.

In some aspects, the padding is located on the inside surface of clothing 112. In some other aspects, the padding is located on the outside surface of clothing 112. In still some other aspects, the padding is located between two layers of clothing 112, with the padding directly connected to one or both layers of clothing. In still some other aspects, the padding is located between clothing 112 and another clothing portion 112 presenting a pocket between the clothing layers 112 proximate the padding location, with the padding directly connected to only the outer clothing layer 112, the inner clothing layer, or both clothing layers 112.

It shall be appreciated that the padding can be connected to clothing 112 and located at different surfaces of clothing layer for various different configurations. For example the padding located proximate the shin region 180 may be located on the exterior surface of clothing 112, while padding located proximate the elbow region 120 may be located between the clothing layer 112 and another clothing portion 120 that forms a closed pocket for the padding, with the padding directly connected to the outer clothing layer 120 of the pocket, and padding located proximate the thigh region 185 located on the interior surface of clothing layer 112.

Figure 3A:
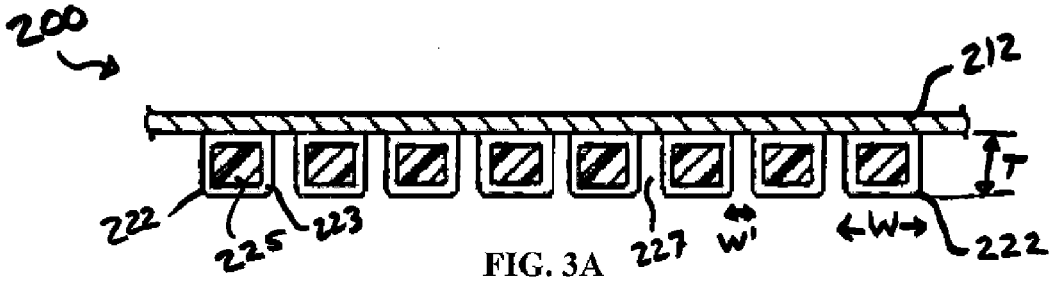
FIG. 3A is a cross-sectional view of pad segments directly attached to a piece of clothing according to an embodiment of the present invention.
Figure 4:
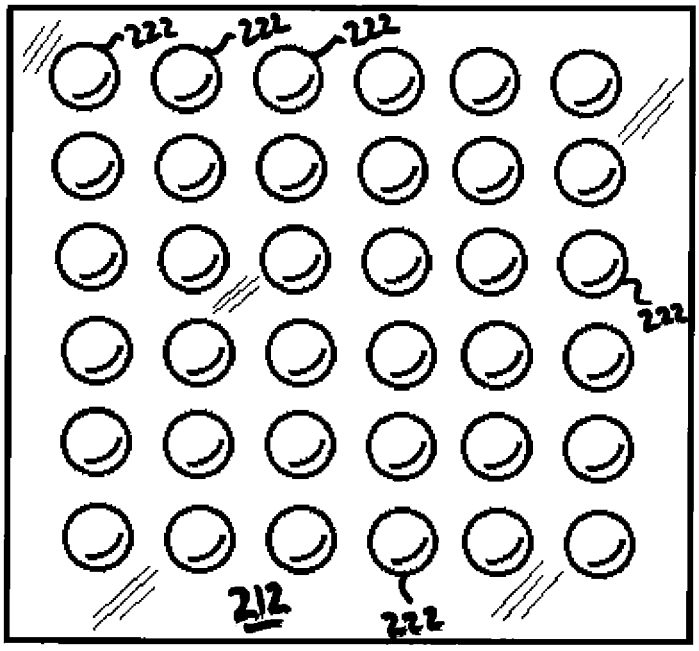
FIG. 4 is a top plan view of a pattern of pad segments attached to a piece of clothing according to an embodiment of the present invention.
Figure 5:
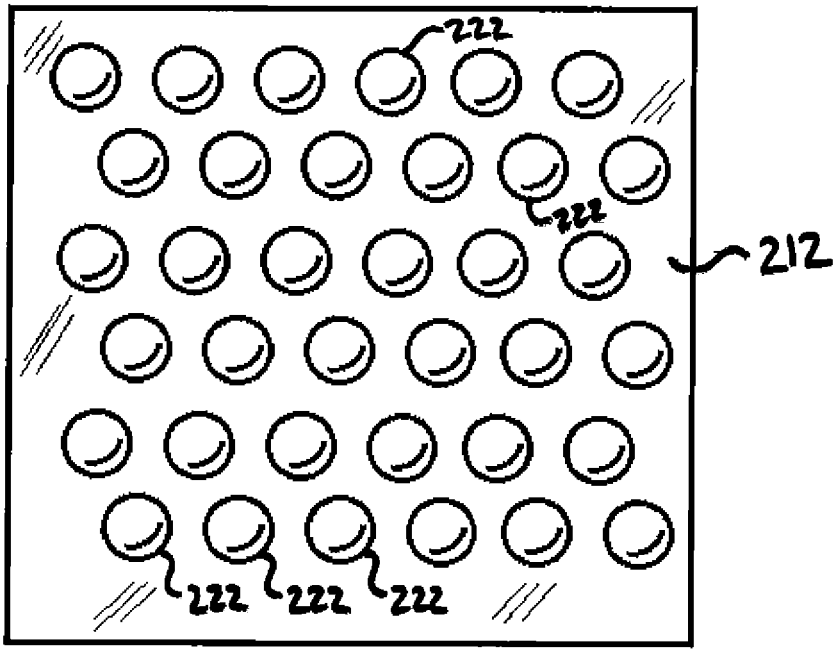
FIG. 5 is a top plan view of a pattern of pad segments attached to a piece of clothing according to an embodiment of the present invention.

As will now be discussed, padding may have different configurations and may be secured to clothing 112 in a variety of ways. As shown in FIGS. 3A-3D, padding 200 may be directly secured to clothing 212. Padding 200 can comprise a plurality of segment pads 222, each of segment pads 222 directly connected to clothing 212 and having protruding portion extending away from at least one surface of clothing 212. The thickness T of the protruding portion can be in the range of about ¼ inch to about 1 inch. The width W of the protruding portion can be in the range of about ¼ inch to about 1 inch. The top surface of the protruding portion may comprise various different geometrical shapes, such as circular, square, triangle, rectangular, columnar, and the like. As shown in FIG. 3A, adjacent segment pads 222 are separated by an interstitial space 227, which can have a width W' be in the range of about ⅛ inch to about ¾ inch. The segmented pads 222 may be arranged such that adjacent segmented pads 222 are aligned with one another, such as illustrated in FIG. 4. In some other embodiments, the segmented pads 222 may be arranged in a staggered configuration relative to one another, such as illustrated in FIG. 5. It shall be appreciated that various different patterns of segmented pads 222 may be utilized.

In some embodiments, padding 200 and segment pads 222 comprise an encasement 223 confining a conformable media 225, such as a polymer material. In some embodiments, the polymer material comprises a visco-plastic polymer that has the properties of a liquid or a soft and pliable material when at rest, but upon high shear, such as a sudden force impact, the visco-plastic polymer has the properties of a solid, with the polymer returning back to its original form when the force of the sudden impact is removed. Encasement 223 can comprise a pliable material that confines the conformable media, such as a polyurethane, urethane, PVC, nylon or neoprene. In a preferred embodiment, the padding material comprises the visco-plastic polymer material Zoombang® of ZB Products, LP located in Irwin, Pa. Encasement 223 may also comprise a tightly woven cloth material that prevents permeation of the conformable media through it.

The padding segments 222 may be secured to clothing 212 by various different methods known to one of ordinary skill in the art of manufacturing clothing, including an adhesive, RF welding, UV welding, double-sided tape, and the like.

Figure 3B:
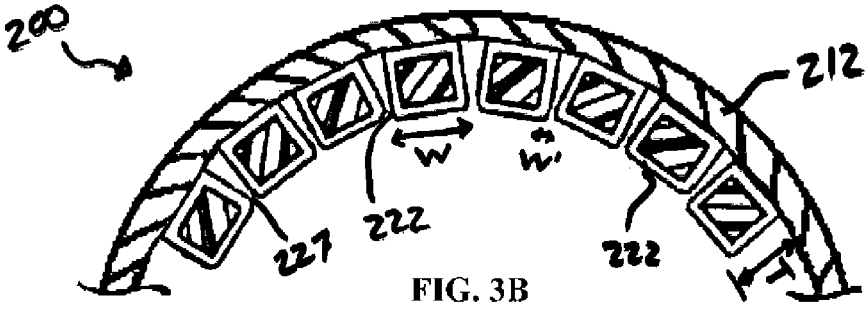
FIG. 3B is a cross-sectional view of the pad segments directly attached to a piece of clothing of FIG. 3A in a curved configuration according to an embodiment of the present invention.
Figure 3C:
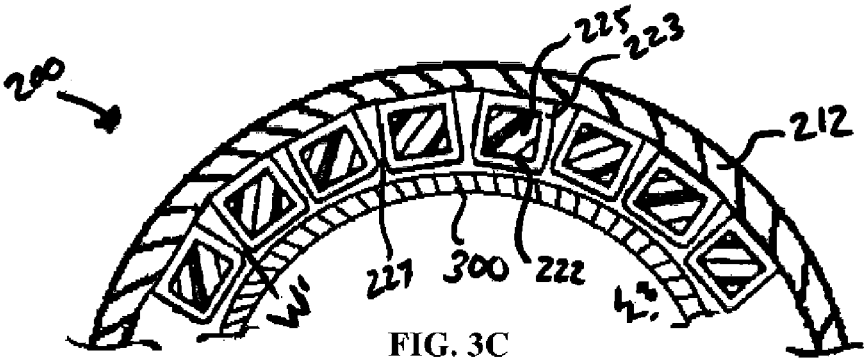
FIG. 3C is a cross-sectional view of the pad segments directly attached to a piece of clothing of FIG. 3A in a curved arrangement with respect to the interior radius of the joint region of the wearer when the joint is in a flexed position such that an interstitial space located between each adjacent pad segment is narrower than in an extended position of FIG. 3A and the protruding portion of each adjacent pad segment is closer together than configuration of FIG. 3A, which correlates with the joint being in an extended position, according to an embodiment of the present invention.
Figure 3D:
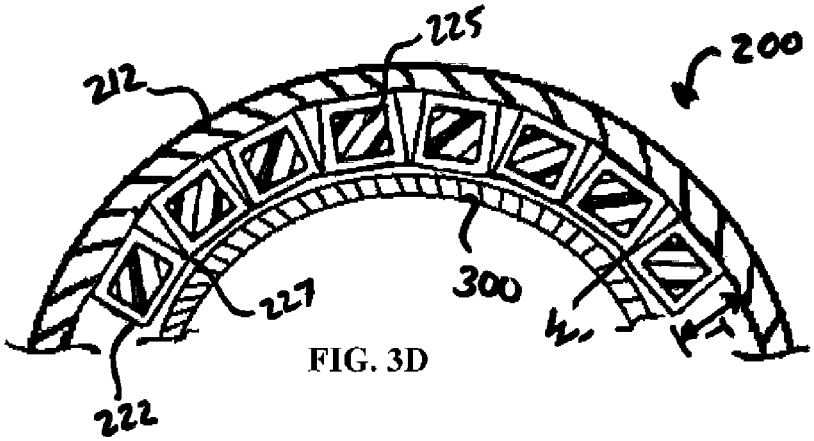
FIG. 3D is a cross-sectional view of the pad segments directly attached to a piece of clothing of FIG. 3A in a curved arrangement with respect to the interior radius of the joint region of the wearer when the joint is in a flexed position such that an interstitial space located between each adjacent pad segment is narrowed to the extent that the protruding portion of each adjacent pad segment contacts one another according to an embodiment of the present invention.

Referring now to FIGS. 3A-3D, padding segments 222 directly secured to clothing 212 may comprise different widths W' of interstitial spaces 227 located between adjacent protruding portions depending upon the underlying surface to which the garment conforms, which thus also affects the relative proximity of adjacent protruding portions. For example, width W' of interstitial space 227 located between adjacent protruding portions is greater in a substantially flat configuration as shown in FIG. 3A than in a curved configuration as shown in FIGS. 3B-3D. As a result, the ends of protruding portions proximally located away from the clothing 212 move closer on the interior radius corresponding with the joint 300 with width W' of interstitial space 227 decreasing.

The fluctuation between a substantially flat configuration as shown in FIG. 3A and a curved configuration as shown in FIGS. 3B-3D can occur when the padding segments 222 are located proximate a joint of the wearer, such as shown in FIGS. 3C-3D, with the substantially flat configuration occurring when the joint (not shown in FIG. 3A) is in an extended position and a curved configuration occurring when the joint 300 (shown in FIGS. 3C-3D) is in a flexed position. As shown in FIG. 3C, the width W' of interstitial space 227 between adjacent protruding portions may exist when the pad segments are proximally located to a joint 300 in a flexed or partially flexed position, but width W' may become essentially zero with the adjacent protruding portions touching one another as shown in FIG. 3D when the joint 300 is in a flexed or further partially flexed position.

In some other embodiments, padding segments 222 may be secured to another common substrate other than the clothing 212 of the garment, such that the padding segments 222 attached to the common substrate can be placed within pockets of the clothing 212. In this configuration, the moveable protruding portions can be configured to be in closer proximity to the wearer's body than the common substrate.

In some embodiments, the garment of the present invention with energy dissipating pad segments may be used alone or in conjunction with pads that shield energy. In some aspects, hard shell material may be used over the underlying soft padding for shin, wrist, sternum, shoulder, and/or spine protection. In some other aspects, the hard shell material can be interspersed with the underlying garment having the energy dissipating pad segments, such as for shin and/or wrist protection.

While specific embodiments of the present invention have been disclosed in detail, those skilled in the art will appreciate that additions, modifications and substitutions are possible, without departing from the scope and spirit of the present invention. The specific embodiments described herein are meant to be illustrative only and not limiting as to the scope of the present invention which is to be given the full breadth of the accompanying claims and any and all equivalents thereof.

What is claimed is:

1. A protective garment comprising:

a piece of clothing having a plurality of pad segments, each of the plurality of pad segments comprising a conformal, energy dissipating polymer composition surrounded by an encasement, each segment of the plurality of pad segments having a protruding portion separated from an adjacent protruding portion by an interstitial space, the plurality of pad segments positioned at a location of the clothing proximate a joint region, wherein the plurality of pad segments located proximate the joint region are arranged such that the protruding portions of adjacent pad segments are spaced apart when the joint region is in an extended position, and wherein the protruding portions of adjacent pad segments contact each other when the joint region is in a flexed position, and wherein the plurality of pad segments are further positioned proximate at least one bodily region chosen from a tailbone, a forearm, a knee, a shoulder, a hip, and a lower back.

2. The garment of claim 1, wherein the plurality of pad segments are connected directly to the clothing.

3. The garment of claim 1, wherein the encasement comprises polyurethane, urethane, PVC, nylon or neoprene.

4. The garment of claim 1, wherein the clothing comprises at least one material chosen from cotton, nylon, polyester, and elastane.

5. The garment of claim 1, wherein the polymer composition comprises a visco-elastic, polymer material.

6. The garment of claim 1, wherein the polymer comprises polyborosiloxane.

7. The garment of claim 1, wherein the clothing is a unitard having sleeves and pant legs.

8. The garment of claim 1, wherein the clothing comprises a shirt having sleeves and either a pair of shorts or a pair of pants.

9. A protective garment conforming to a wearer's body contours, the garment comprising:

a plurality of pad segments comprising a conformal, energy dissipating polymer composition surrounded by an encasement connected directly to at least one piece of clothing, a first portion of the plurality of pad segments located proximate a joint region and a second portion of the plurality of pad segments located proximate a buttocks region, wherein the first portion of the plurality of pad segments located proximate the joint region are arranged such that a protruding portion of each pad segment is spaced apart from the protruding portions of adjacent pad segments when the joint region is in an extended position, and wherein the protruding portion of each pad segment contacts the protruding portions of adjacent pad segments when the joint region is in a flexed position.

10. The garment of claim 9, wherein the joint region is proximate an elbow region or a knee region.

11. The garment of claim 9, wherein the encasement comprises polyurethane, urethane, PVC, nylon or neoprene and the polymer composition comprises a visco-elastic, semi-solid polymer material.

12. The garment of claim 9, wherein the clothing comprises at least one material that conforms to the contours of the wearer's body chosen from cotton, nylon, polyester, and elastane.

13. The garment of claim 9, wherein the clothing is a unitard having sleeves, pant legs, and a slit on a backside proximate a neck area.

14. The garment of claim 9, wherein the clothing comprises a shirt having sleeves and either a pair of shorts or a pair of pants.

15. The garment of claim 9, wherein the plurality of pad segments are further positioned proximate at least one region of the wearer chosen from a tailbone, a forearm, a shoulder, a hip, and a lower back.

16. The garment of claim 9, wherein the clothing comprises sleeves having a thumb hole and a pair of pants with pant legs having stirrups.

17. The garment of claim 9, wherein the clothing and the encasement are each made of nylon.

18. The garment of claim 9, wherein the clothing and the encasement are made of materials suitable to be welded to one another.

* * * * *